US006024511A

United States Patent [19]

Ross

[11] Patent Number: 6,024,511

[45] Date of Patent: Feb. 15, 2000

[54] ASPHALT IMPRINTING APPARATUS

[76] Inventor: Guy Ross, 2446 Bank St. #304, Ottawa, Ontario, Canada, K1V 1A8

[21] Appl. No.: 09/092,033

[22] Filed: Jun. 5, 1998

[51] Int. Cl.[7] ..... E01C 23/02

[52] U.S. Cl. ..... 404/93; 404/124

[58] Field of Search ..... 404/93, 72, 75, 404/89, 124

[56] References Cited

U.S. PATENT DOCUMENTS

| | | | |
|---|---|---|---|
| 1,895,045 | 1/1933 | Moore | 404/93 |
| 3,516,340 | 6/1970 | Perkins | 404/93 |
| 3,832,079 | 8/1974 | Moorhead . | |
| 3,910,711 | 10/1975 | Moorhead . | |
| 3,910,738 | 10/1975 | Chandler et al. | 404/124 |
| 4,105,354 | 8/1978 | Bowman . | |
| 4,108,586 | 8/1978 | Gresham, Jr. | 425/89 |
| 4,271,111 | 6/1981 | Sherber | 264/71 |
| 5,022,783 | 6/1991 | Jones | 404/122 |
| 5,033,906 | 7/1991 | Jordan | 404/124 |
| 5,061,172 | 10/1991 | Fennessy, Sr. | 404/89 |
| 5,073,062 | 12/1991 | Leone | 404/93 |
| 5,215,402 | 6/1993 | Stowell et al. . | |
| 5,228,799 | 7/1993 | Sondreal | 404/124 |
| 5,421,670 | 6/1995 | Meirick | 404/124 |

*Primary Examiner*—Thomas B. Will
*Assistant Examiner*—Kristine Markovich
*Attorney, Agent, or Firm*—Ronald G. Bitner

[57] ABSTRACT

An apparatus for forming a pattern on the surface of asphalt comprising an endless belt having a surface formed of an elastic material and having a pattern in a form corresponding to a pattern to be impressed into the asphalt. The apparatus includes a belt pressing device, which may be in the form of a weighted roller or plate, for pressing the belt into the asphalt; and a pair of rollers spaced from either side of the belt pressing device, and at a higher elevation with respect to the asphalt surface to provide controlled lifting of the belt from the pressed asphalt. The belt is formed of an elastic material which has little compressibility, so that when pressed down by the belt pressing device, it spreads laterally outward to form pattern elements that are wider than when pressure is released, to provide clean separation from the asphalt surface.

8 Claims, 3 Drawing Sheets

ASPHALT IMPRINTING APPARATUS

FIELD OF THE INVENTION

This invention relates to an apparatus for imprinting a pattern onto the surface of asphalt.

BACKGROUND OF THE INVENTION

The aesthetic appearance of roads, parking lots and driveways, particularly those made of asphalt, can be improved by imprinting a pattern onto the surface, which for example, can be made to resemble brick, cobblestone, stone, or the like.

Many methods for imprinting asphalt or concrete have been tried, or proposed. For example, U.S. Pat. Nos. 3,832,079 and 3,910,711 to Moorhead describe a concrete or paving forming apparatus and process whereby a roller forms a pattern in the pavement and an intervening sheet of plastic film is said to prevent binding and gouging of the pavement surface. U.S. Pat. No. 4,105,354 to Bowman shows a wheel-like imprinting device having blades on a circular frame, and is propelled and ballasted by a person. U.S. Pat. No. 5,215,402 to Stowell & Zaseybida describes a grid-like template that is progressively compressed into, and lifted from, the asphalt surface. This method is labor intensive and leaves many defects caused by the multiple seams caused by the multiple seams and also by compressing with rollers or plates, the steel cables move and make prints that are not necessarily uniform. As well, by walking on fresh asphalt to maneuver the grids, many marks are left. The slower process also causes problems with maintaining proper temperature of the asphalt.

SUMMARY OF THE INVENTION

An object of the present invention to provide an improved apparatus for forming a pattern on the surface of asphalt Without damage to the surface.

A specific object of the present invention is to provide an improved apparatus for forming a pattern on the surface of asphalt without damaging the produced patterned surface.

It has been found that improved imprinting of asphalt can be achieved by an arrangement of rollers and a patterned belt made of elastic material and whereby the rollers are arranged such that the belt is gradually lifted from the surface. The use of an elastic material allows the belt to contract slightly when roller pressure is released to provide a clean separation from the asphalt surface.

The present invention provides an apparatus for forming a pattern on the surface of asphalt comprising an endless belt having a surface formed of an elastic material and having a pattern in a form corresponding to a pattern to be impressed in the asphalt; belt supporting means comprising belt pressing means for pressing the belt into the asphalt, and guide means spaced from either side of the belt pressing means and disposed at a higher elevation with respect to the asphalt surface to provide controlled lifting of the belt from the pressed asphalt; and means for applying downward force to the belt pressing roller.

DESCRIPTION OF THE PREFERRED EMBODIMENTS

Figure 1:
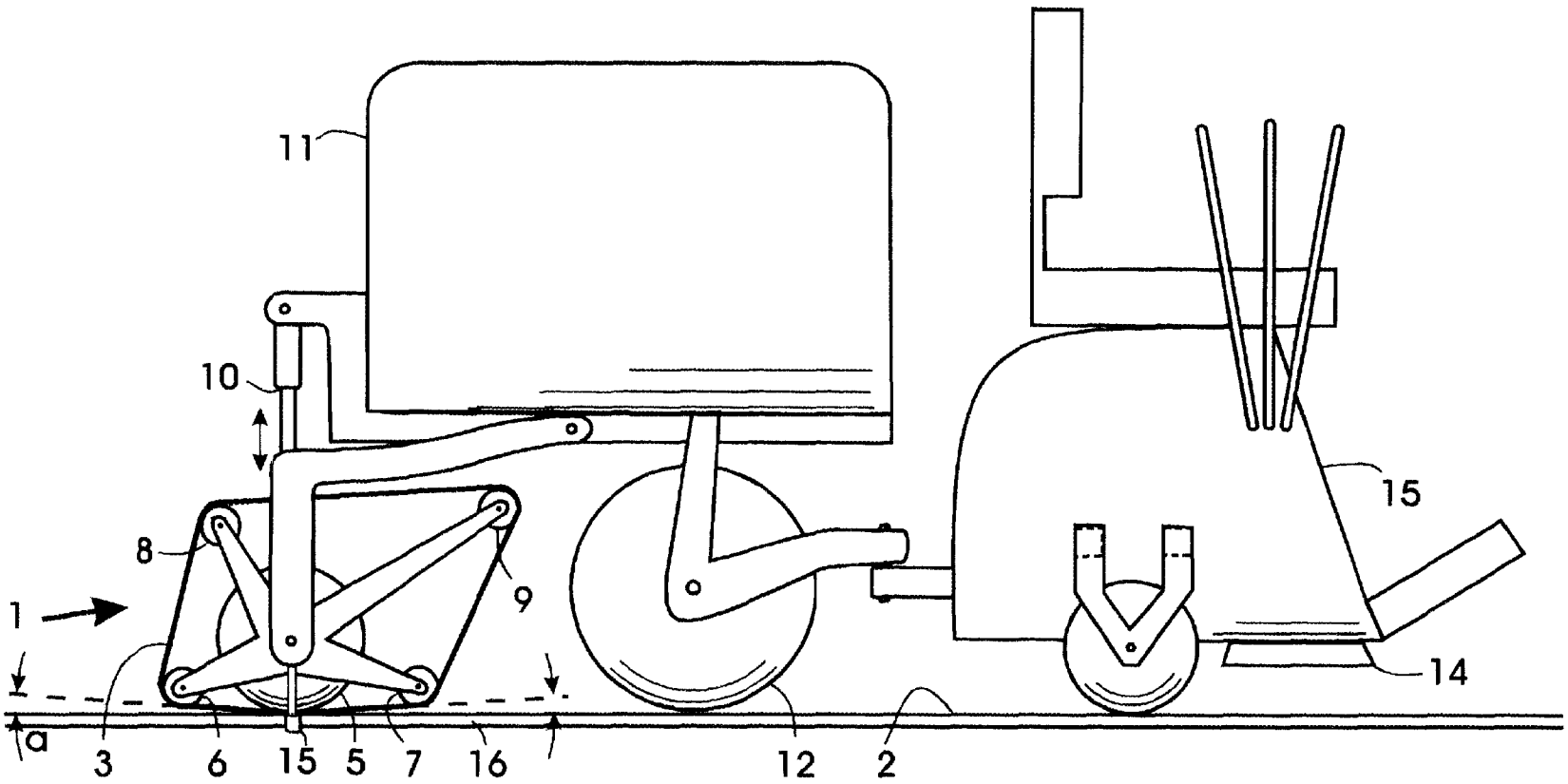
FIG. 1 is a schematic representation of one embodiment of the invention.
Figure 2:
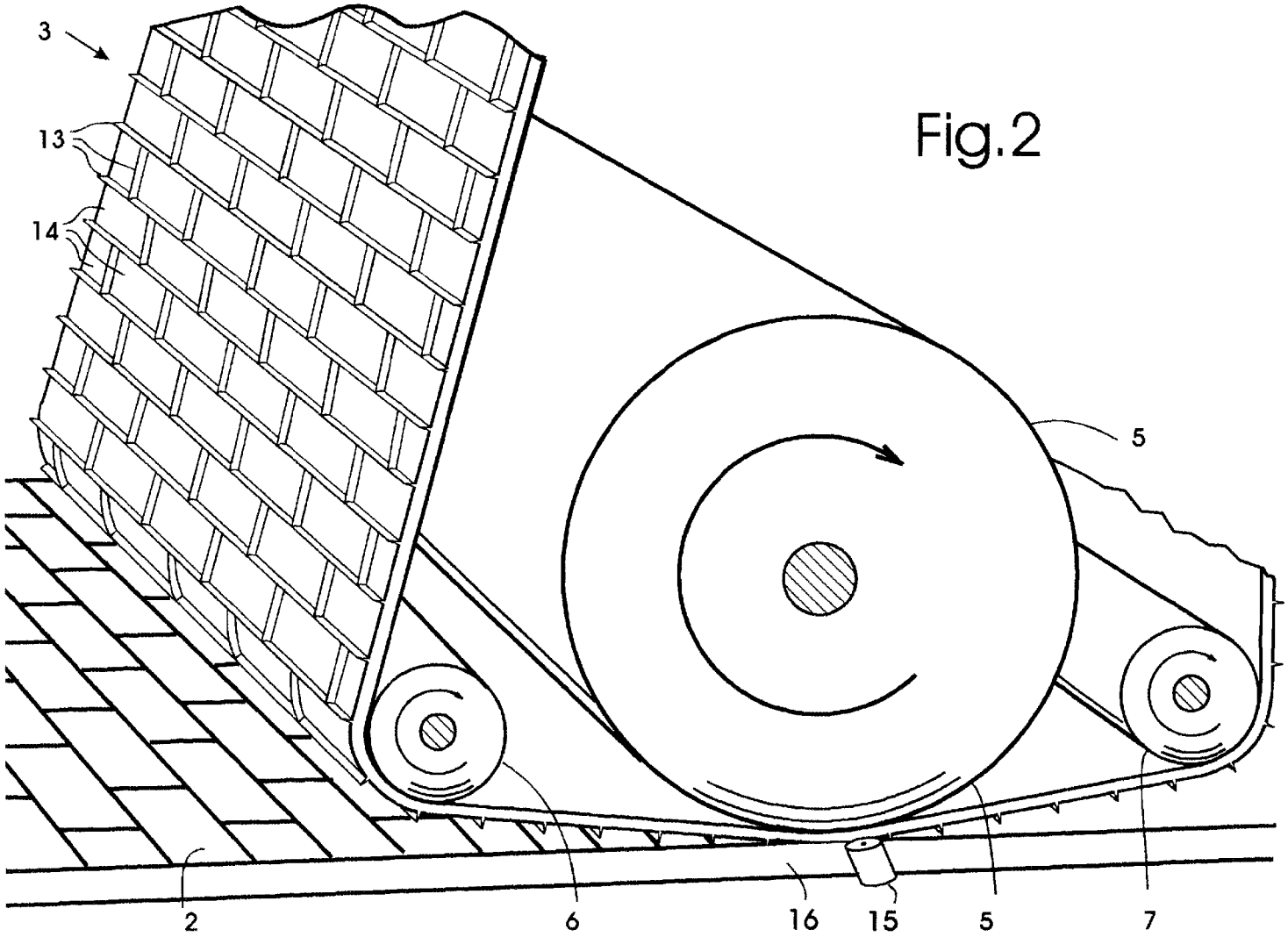
FIG. 2 is an enlarged view of a portion of the apparatus shown in FIG. 1, showing details of the rollers, belt, and printing elements.

With reference to FIGS. 1 and 2, the present invention comprises a pattern printing apparatus 1 for forming a pattern on the surface of asphalt 2. The apparatus includes an endless belt 3 having a surface formed of an elastic material and having pattern forming elements which include the projecting elements 13 and the base portions 14, that conform to the pattern to be impressed in the asphalt. The base portions 14 may be flat, or shaped to contribute to the pattern. The belt 3 is supporting by belt pressing means shown in the form of a weighted roller 5, a pair of guide means in the form of rollers 6 and 7 spaced on either side of the main roller 5, and belt tightener and positioning roller means 8 and 9 disposed above the main and secondary rollers.

The embodiment as shown in FIG. 1, the present invention is shown attached to a roller apparatus, which includes the roller 12 and is traversed by a suitable powered tractor 15. The pattern is formed as the apparatus is traversed along the surface of heated asphalt.

A downward force to the printing roller assembly 1, as well as the roller 12, can be provided by weight which is shown in the form of a tank 11 which may be filled as required with water, or the like. Pressure can be controlled and/or the imprinting roller 1 lifted by means of an hydraulic actuator 10 which distributes the weight of tank 11 between printing assembly 1, and roller 12. The actuator 10 also allows the printing assembly to be lifted from the asphalt surface when not printing.

The rollers 6 and 7 are disposed at a higher elevation than the main roller 5 with respect to the asphalt surface, to provide gradual controlled lifting of the projecting pattern forming elements 13 of the belt from the pressed asphalt surface, to reduce the possibility of damage to the formed surface.

The belt is formed of a deformable material, such as rubber, with a certain degree of elasticity, but little compressibility, so that when pressed down by the roller 5, it spreads laterally outward whereby the pattern forming elements 13 will be wider than when roller pressure is subsequently released. The use of such an elastic material allows the belt pattern forming elements 13 to contract slightly when roller pressure is released to provide a clean separation from the asphalt surface.

A material found to be suitable for the belt was Buna-N polymer rubber having an ASTM Durometer, type "A", Hardness of 80. It appears that suitable hardness values are in the range of from 65 to 85. The material should be capable of withstanding the elevated temperature of the asphalt surface and the oil and chemicals in the asphalt. A belt found to be suitable had a thickness of ¼ inch and a relief pattern having a depth of 7/16 inch. During the printing process a pressure of about 35 to 40 psi to the printing roller provided lateral expansion of the pattern elements of about 4% while the depth is decreased. As indicated above, the reduction of the lateral dimension to its original dimensions when pressure is released, facilitates the clean separation of the belt from the asphalt surface.

As indicated above the arrangement of rollers 6 and 7, specifically their position at a higher elevation than the main roller 5 with respect to the asphalt surface, provide gradual controlled lifting of the projecting pattern forming elements 13 of the belt from the pressed asphalt surface, also serve to reduce the possibility of damage to the formed surface. A suitable arrangement for a ⅜ inch deep pattern had the rollers 6 and 7 about ½ inch above and 3 inches on either side of the main roller 5 for slope angle a of ⅙. It can be seen that a different angle a would be appropriate for a different pattern depth.

To ensure that the asphalt surface is at a suitable deformable temperature for imprinting, which was found to be about 160° F., a suitable heater 15 may be provided. Heat may be provided, for example, by steam or by a propane radiant heater.

To limit the temperature of the belt, the apparatus may be provided with cooling means such as by applying water thereto, which also serves to keep the belt clean. Also, the surface of the belt may be sprayed or otherwise treated with a material to prevent asphalt particles from sticking to it.

Figure 3:
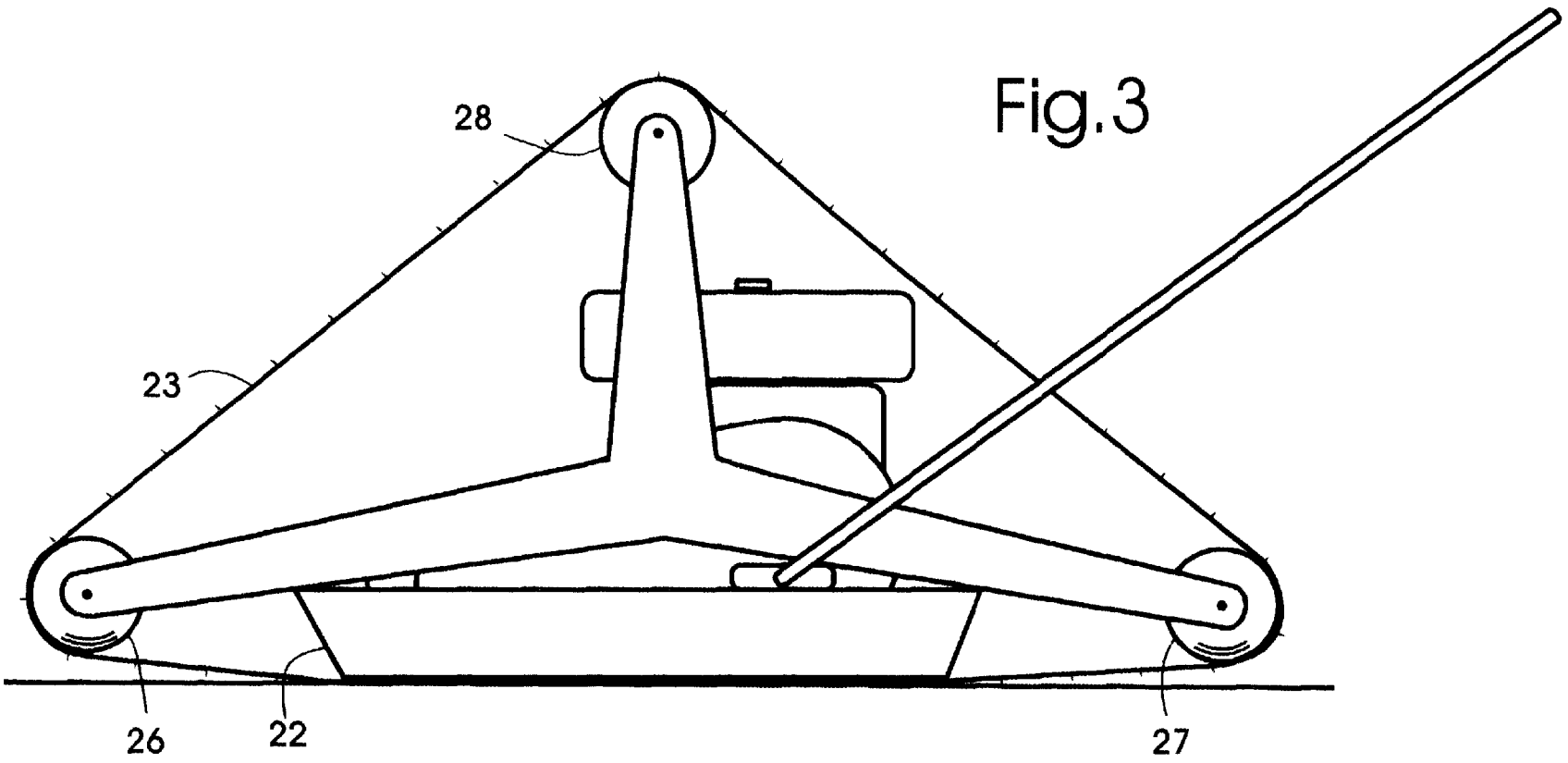
FIG. 3 is a schematic representation of another embodiment in which the invention is incorporated into a compactor.

FIG. 3 is a schematic representation of another embodiment in which the invention is incorporated into a compactor. The basic operation is similar to the embodiment shown in FIG. 1, and includes a belt 23 mounted on rollers 26, 27, and 28. The embodiment of FIG. 3 differs from that of FIG. 1 in that the belt pressing means is in the form of a plate 22, rather than a roller 5 as shown in the embodiment of FIGS. 1 and 2. The pressing force is provided by the weight of the apparatus on the plate 22. As with the embodiment of FIG. 1, the pattern is formed when the compactor is traversed along the surface of heated asphalt.

It will be understood that various types of patterns may be imprinted, with corresponding changes in the belt pattern. The pattern may simulate brick, cobblestone, stone, or provide a unique artistic pattern. It should be noted that the pattern forming design need not be limited to the projecting elements 13 as shown in FIG. 1, but pattern elements may be included in the base portion of the belt, to shape the upper surface of the imprinted surface. For example, while the projecting elements 13 may simulate the spaces between bricks or stones, the base portions 14 may be provided with irregularities to simulate irregularities in the surface of cobblestone, or the like. Also, belts of various widths, or lateral extensions of the various printing components, may be provided to print various surface widths.

The apparatus may be provided with an edge roller 15 to trim the edge of the asphalt while the vehicle traverses for the printing operation.

The guide means, shown in the form of rollers 6 an 7 in FIGS. 1 and 2, and 26 and 27 in FIG. 3, may also be in the form of a plate, or other smooth, low friction, surface.

It will also be appreciated that the patterned surface produced by the present invention my be treated with a colored sealer or other suitable colorant to provide a more realistic simulating effect.

What is claimed is:

1. An apparatus for forming a pattern on the surface of asphalt comprising:

an endless belt having a surface formed of an elastic material and having pattern forming elements in a form corresponding to a pattern to be impressed in the asphalt;

belt supporting means comprising belt pressing means for pressing the belt into the asphalt, and a pair of guide means spaced from either side of the belt pressing means and disposed at a higher elevation with respect to the asphalt surface to provide controlled lifting of the belt from the pressed asphalt;

means for applying downward force to the belt pressing means; and wherein the material forming the belt has sufficient elasticity to provide some laterally widening of the pattern forming elements on the belt surface when subjected to the pressure against the asphalt surface, such that upon release of pressure the pattern forming elements on the belt surface narrow to facilitate release from the asphalt surface.

2. The device of claim 1, wherein the belt pressing means includes a roller.

3. The device of claim 1, wherein the belt pressing means includes a plate.

4. The device of claim 1, further comprising belt tightener means disposed above the belt pressing means and rollers for maintaining tension on the belt.

5. The device of claim 1, further comprising means for controlling the pressure to the belt pressing means.

6. The device of claim 5, wherein the belt pressing means comprises a belt pressing roller, and wherein the means for controlling the pressure to the belt pressing roller comprises an additional roller spaced from the belt pressing roller and an hydraulic actuator for controlling the weight distribution between the said additional roller and the belt pressing roller.

7. The device of claim 1, wherein the pattern forming elements comprises projecting elements and base portions.

8. The device of claim 1, wherein the guide means includes a roller.

* * * * *